United States Patent [19]

Grüber

[11] 4,384,867

[45] May 24, 1983

[54] METHOD FOR TREATING A WEB OF MATERIAL WITH FOAM

[75] Inventor: Heinz Grüber, Tönisvorst, Fed. Rep. of Germany

[73] Assignee: Eduard Küsters, Krefeld-Forstwald, Fed. Rep. of Germany

[21] Appl. No.: 266,817

[22] Filed: May 27, 1981

[30] Foreign Application Priority Data

May 30, 1980 [DE] Fed. Rep. of Germany ..... 3020668

[51] Int. Cl.[3] ..... D06P 5/02

[52] U.S. Cl. ..... 8/477; 8/149.1; 427/262; 427/373

[58] Field of Search ..... 8/477, 149.1; 427/261, 427/244, 273, 373, 262

[56] References Cited

U.S. PATENT DOCUMENTS 3,990,840 11/1976 von der Eltz et al. ..... 8/149.1 X 4,299,591 11/1981 Gregorian et al. ..... 8/477

FOREIGN PATENT DOCUMENTS

WO80/00545 4/1980 PCT Int'l Appl. ..... 427/350

OTHER PUBLICATIONS

International Application No. PCT/US79/00759.

*Primary Examiner*—Evan K. Lawrence

*Attorney, Agent, or Firm*—Shoemaker and Mattare, Ltd.

[57] ABSTRACT

A method for treating a web of material such as rug with a treatment medium in which one treatment medium is applied as part of a layer of foam to the advancing web and the foam allowed to act thereon and, in order to obtain effects not obtainable with the single layer of foam, a further treatment medium is applied to the foam as a foam, liquid, paste or in solid form and allowed to interact with the foam before either treatment medium is fixed, with both treatment media acting on the web.

6 Claims, 6 Drawing Figures

FIG. 1
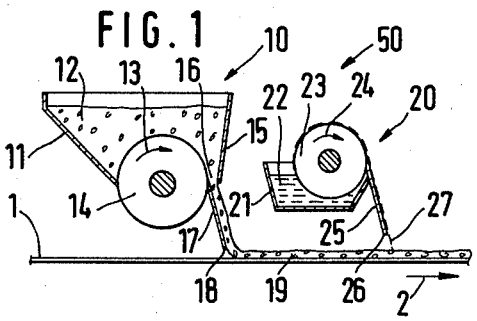
FIG. 2
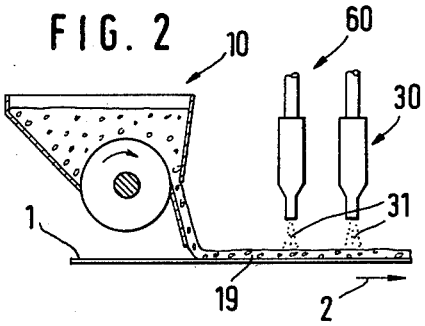
FIG. 3
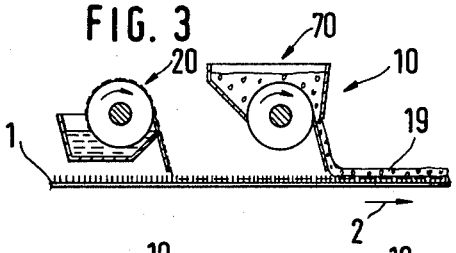
FIG. 4
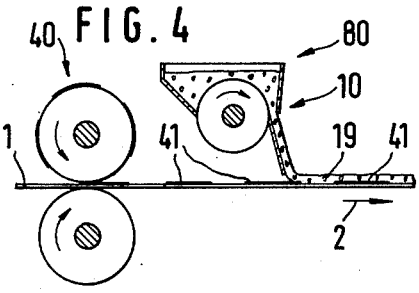
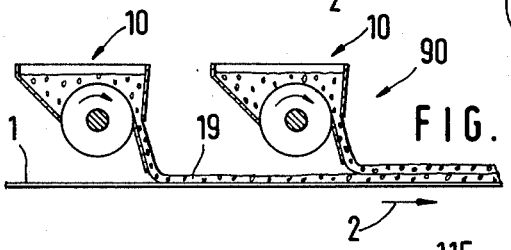
FIG. 5
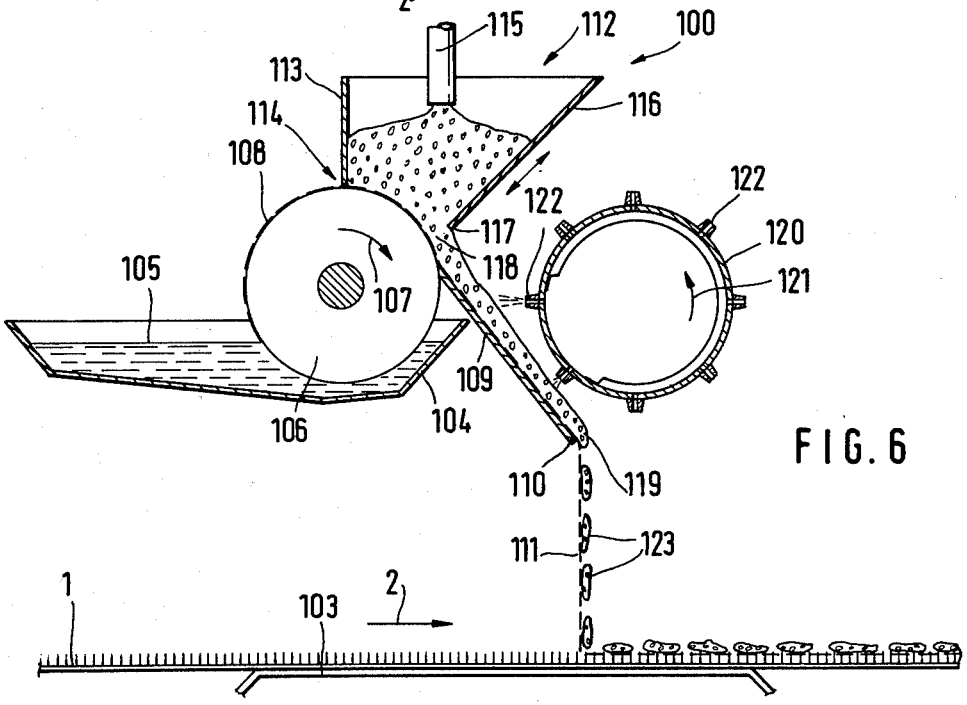
FIG. 6

METHOD FOR TREATING A WEB OF MATERIAL WITH FOAM

BACKGROUND OF THE INVENTION

This invention relates to the treatment of an advancing web of material in general, and more particularly, to an improved method of treating an advancing web utilizing foam containing a treatment medium.

A method in which dyes and/or finishes, along with chemicals required for the fixation thereof, are applied to planar textile structures in the form of foam, is described in DE-OS No. 2214377. In the disclosed method, however, the number of different possibilities for varying the patterns is limited because the application takes place over the entire surface in only one stage.

Apparatus for applying foam to a moving web is disclosed in DT-OS No. 2631340 with improved apparatus of this nature described in co-pending United States application No. 67,998, abandoned, assigned to the same assignee as the present invention. Furthermore, another type of improved foam treating apparatus is disclosed in co-pending application Ser. No. 173,339, also assigned to the same assignee as the present invention.

Because of the limited number of possible variations in patterns using the apparatus and methods of the prior art, it is thus, an object of the present invention to provide a method and apparatus which permits many different variations for applying patterns in a basic method which utilizes foam as the vehicle for applying a treatment medium in a layer to an advancing web such as a textile web.

SUMMARY OF THE INVENTION

In accordance with the present invention, this object is accomplished by applying a layer of foam containing a web treatment medium to a web and allowing the layer of foam to act thereon, and applying at least one further treatment medium in liquid form to the foam and allowing it to interact with the treatment medium contained in the foam before either the foam or the further treatment medium becomes fixed, with both treatment media acting on the web. In other embodiments, the further treatment medium may be a foam, paste, or solid.

Thus, the application of foam is combined with the application of a further treatment medium. The interaction obtained may be of a chemical or physical nature, depending on the type of treatment medium selected. Such an interaction occurs when the applied quantities of the treatment medium come in contact with each other, be it prior to application to the web or be it on the web, as will usually be the case. For practical reason, the application will usually be performed by pouring, spraying, dropping, etc., the treatment medium from above onto a substantially horizontal web. However, the invention is not limited to this type of application. The types of treatment medium which are of primary interest, are dyestuffs, since the present invention had its origin in the technology of dying textiles, particularly rugs. However, the present invention is not limited to textiles, nor need the obtainable patterns be dye patterns. Patterns in the surface structure are also included. The treatment medium can also be substances which are not used directly for producing patterns such as wetting agents, resists, thickeners, fixers and the like.

In addition to textile materials in web form, in particular rugs, other materials, such as, bonded fabric, paper, cardboard, plastics, sheet metal, webs of press chip material, particularly wood chipboard and the like, can also be used as substrates. It is, of course, within the scope of the present invention to apply both treatment media uniformly over the entire surface of the web. In accordance with one embodiment of the present invention, however, the first and/or the second treatment medium is applied as a pattern so that the application areas of the two media on the web overlap, at least partially. Interaction according to the present invention then takes place in the overlap areas. This can be accomplished in two basic ways. In the first way, the foam containing the first treatment medium is applied first and the further treatment medium subsequently applied thereto. In this way the further treatment medium gets onto the foam layer and interacts with it. The structure of the foam layer, which has a certain amount of foam stability and is nevertheless moist and porous plays an important part in the pecularity of the obtained pattern. The medium can be a liquid film which can be sprayed, or poured on in the form of a fine haze which extends transversely across the web. Tests in which the treatment media where dyeing liquids, have shown that the dyeing liquor which is applied on the foam in the form of a film and should, of course, be different from the dyeing liquid contained in the foam layer, trickles through between the foam bubbles and generates a rather unique micro-structured pattern which, however, is uniformed overall. How this pattern turns out depends, as in all embodiments of the present invention, on the structure, i.e., bubble size, of the foam, on the type and quantity of second dyeing liquid, on the mutual wetability or solubility of the two dyeing liquids, on the time between the application and the start of steaming, etc. In other words, it depends on a multitude of factors, well known to affect such treatments, which must tested by experiment in each individual case to get a specific desired result.

In accordance with another embodiment, powder or fine grain material consisting of pigment is utilized. After it impinges on the foam, it begins to dissolve and is distributed in the liquid of the foam. As a result, color veils or spots of particularly high color intensity, partly feazing in spider like fashion, of particularly high color intensity are superimposed on the uniform covering caused by the foam at the points of impingement.

The second possibility is one in which the further treatment medium is applied first and the foam containing the first treatment medium subsequently applied thereon. In this case, the foam thus modifies the effects obtained with the first treatment medium. An important application of this is in the dyeing of rug webs. In such dyeing, many efforts have already been made to prevent what is known as a frosting effect in the pile material. This effect occurs when the tips of pile threads are not dyed properly and remain light. The reason for this is that when the dyed liquor is poured on it sinks into the pile too quickly and does not have enough opportunity to reside for a long enough time at the outer end of the pile threads to coat the fiber. In accordance with the present invention, if the further treatment medium consist of dye liquor which is poured on, it suffers from the problem of frosting and if the foam which is subsequently applied is formed from the same dye liquor, then the foam remains at the surface of the pile material at least for a certain period of time so that the dyeing liquid contained therein has an opportunity to coat the tips of fibers preventing a frosting effect. In accordance with another aspect of the present invention, the tips may be given a shading different from the bottom of the pile, in which case, the dye liquor in the foam must be chosen to be different from that of the first application.

A third basic possibility is one in which the further treatment medium and the foam containing the first treatment medium are applied simultaneously. This can be accomplished by using apparatus having a run-off surface over which liquid is allowed to flow dropping from the lower edge thereof as a shroud of film onto the web material and by then depositing, on the film flowing down over the run-off surface, a foam containing a treatment medium which is then allowed to flow down onto the web together with the film.

The apparatus for accomplishing the application of the liquid further treatment medium can be of the type described in DE-AS No. 16 35 004. This apparatus and its associated method are used for applying relatively large quantities of a dye liquor to rugs with application being made uniformly over an area. Typically, the run-off surface forms a wiper. A trough with dye liquor is provided extending transversely across the web of material. A cylinder has its lower part immersed in the dye liquor, the cylinder also extending across the width of the web material. The cylinder picks up dye liquor along its surface as it rotates. The run-off surface designed as a wiper rests against the descending side of the cylinder and acts to wipe off the dye liquor which is then transferred to the run-off surface in the form of the film. The dye liquor then falls from the edge of the run-off surface as shroud or veil of liquid. Absent any further steps or apparatus, the dye liquor is a uniform film over the width of the web and thus, is uniformly applied across the width of the web of material passing by underneath.

By adding foam to the descending dye liquor in accordance with the present invention, it is possible to modify the pattern application obtainable. The foam is transferred together with the liquid to the web of material and in the process interacts with the liquid to a certain extent. Assuming that the web is porous, for example, textile material, the liquid will sink into the web of material relatively quickly, while the foam initially remains on the surface of the web of material. This results an effect which cannot be obtained with liquid or foam alone.

In one embodiment, a uniform foam layer is applied to the film of dye liquor flowing down over the run-off surface. The foam layer can either be transferred uniformly to the web of material as just described, or can be further varied. In another embodiment, the foam is applied to the film in the form of a pattern, i.e., it is only applied at some points or areas. If the foam is transferred to the web of material only at certain points, and its effect develops accordingly, only certain areas of this surface of the web of material will have a non-uniform pattern generated thereon.

In both cases, that is, either with the uniformly applied foam layer or with a foam layer applied in zones or spots, an additional variation can be accomplished, according to the present invention by varying the foam layer present on the film in a predetermined pattern. Thus, the foam can be displaced or destroyed in some places either by mechanical attack or chemical attack, for example by spraying chemicals which make the foam collapse onto the foam at certain points.

In the illustrated embodiment of the present invention, the foam layer on the film of liquid is blown into a pattern. The foam layer is interrupted or blown away in spots so that a loosening of the area coverage of the web of material with the foam is obtained.

One embodiment of apparatus according to the present invention includes a run-off surface extending across the web of material and inclined toward the web of material having it lower edge above the web. A liquid film is applied to the upper edge of the run-off surface and an applicator is provided by means of which a foam layer can be applied to the liquid running down over the run-off surface. Specifically, the liquid can be applied to the run-off surface in the manner described above. For applying the foam, a foam container open against the roll which is immersed in the trough, is provided. On the side of the roll descending during rotation an opening extends over the width of the web of material from which a layer of foam can be transferred to the film of liquid flowing down over the wiper.

For disturbing the foam layer, a rotatable nozzle tube of the type described in U.S. Pat. No. 4,170,958 may be used. This tube with a plurality of nozzle openings in it is disposed transversely to the web of material and is adopted for movement back and forth transversely to the web of material. The outlet openings are distributed over its surface and are supplied with a fluid, e.g., air, from a compressed air supply, for example. However, the fluid medium directed through the tube need not be air, but may be a different gas or liquid, for instance, a liquid which influences the foam, e.g., makes it collapse.

Practical experience has shown that the patterns change greatly if the height of the lower edge of the run-off surface above the web of material is varied. For this reason, apparatus in which the height of this surface can be varied is described.

BRIEF DESCRIPTION OF THE DRAWINGS

FIG. 1 is a schematic illustration of a first embodiment of the present invention in which means are provided first for applying a layer of foam and then for applying thereover a layer of a second, liquid treatment medium.

FIG. 2 is a view of similar apparatus but in which the application of the second medium is in the form of distinct particles rather than a film of liquid.

FIG. 3 is an illustration similar to FIG. 1 in which the liquid is applied first followed by the foam.

FIG. 4 is a similar view in which a paste is first applied by a printing roll followed by application of foam.

FIG. 5 illustrates an embodiment where successive layers of foam are applied to the substrate.

FIG. 6 illustrates an embodiment including a roll, trough and run-off surface arrangement for applying a liquid with a foam applicator adapted to apply a layer of foam over the liquid and, also, a nozzle tube for applying a fluid to disturb the pattern of foam on the liquid.

DETAILED DESCRIPTION OF THE INVENTION

In each of the illustrated embodiments, a web of material 1 advances from the left to right in the direction of an arrow 2 substantially horizontally and is supported in the region of application by means of slide plates, support rolls, or the like. In the apparatus of FIG. 1, designated generally as 50, a foam applicator 10 followed by a liquid applicator 20 is shown. The foam applicator 20 comprises a foam container 11 extending transversely above the web of material, a distance thereabove. Foam is fed continuously The container 11 through a feeding device, not shown. A container is opened towards its bottom and closed at that point by a cylinder 14 rotating in the direction of arrow 13. Cylinder 14 is sealed to the foam container on the side ascending during rotation. The front wall 15 of the foam container 11 forms, with cylinder 14, a tapered channel 16 through which foam is carried along as cylinder 14 rotates. At the end of channel 16, the foam is transferred to a wiper 17, flowing down the wiper and dropping from the lower edge thereof in a layer 19 on the web of material as the web advances in the direction 2.

Following the foam applicator 10, is a liquid applicator 20 comprising a liquid trough 21 extending across the web and spaced therefrom. A liquid 22 is contained in the trough 21 and the lower part of a cylinder 23 is immersed in the liquid. As the cylinder rotates in the direction of the arrow 24 it carries along liquid 22 at its surface with the liquid wiped off the surface of the cylinder 23 by a wiper 24 resting against it on the descending side of the cylinder. Wiper 25 is inclined downwardly at an angle with respect to the web of material 1 and, thus, the dyeing liquor contained in the trough 21 flows down the wiper 25 from the lower edge 26 of the wiper onto the web of material in a uniform shroud or veil 27.

The foam 12 is formed from a dyeing liquor. The liquid 22 is likewise a dyeing liquor. After impinging on the foam layer 19, the dyeing liquor 22 penetrates the foam and comes into interaction with the dyeing liquor of the foam 12 on the web of material 1.

In the apparatus 60 according to FIG. 2, a foam applicator 10 which generates a foam layer 19 on the web of material 1 is followed by a sprinkling device 30. The sprinkling device 30 sprinkles a granular material, which contains or consists of pigment, on the foam layer 10 either uniformly or in a pattern. Instead of granular material 19, a fine powder can also be sprinkled into the foam. The powder or granular material 31 is dissolved in the liquid of the foam layer 19 and leads to a veil-like or dot-shaped modification of the coloring produced by the foam layer 19.

The apparatus 70 shown in FIG. 3 is the reverse of the apparatus 50. In the travel direction 2 of the web of material, for example a pile rug web 1, a liquid applicator comes first followed by a foam applicator. The liquid applicator 20 dispenses a relatively large amount of liquid which is sufficient for dyeing the entire rug onto the web of material 1. The foam applicator 10 follows the liquid applicator 20 placing on the web of material, which is loaded with the liquid, a foam layer 19 which will remain for a certain length of time on the tips of the pile to insure sufficient dyeing of the tips, be it with the same or different hue.

In the apparatus 80 shown in FIG. 4, the web of material 1 has a pattern printed on it by a printing mechanism 40, for example, a silk screening device. The web of material 1 including the printed areas 41 is then covered by a foam layer 19 generated in a foam applicator 10 following the printing mechanism 40. At the printed areas 14, the foam is applied over the printing paste which is not yet fixed and interacts therewith.

In the apparatus 90 shown in FIG. 5, two foam applicators are arranged in tandem. Thus, two foam layers are applied one on top of the other and interact with each other. In this manner irridescent or veil-like colorings, for example, can be produced, if both foams are prepared from dyeing liquors.

In the embodiment of FIGS. 1, 2 and 5 the "further" treatment medium is applied to a foam layer 19 which is already on the web of material 1. In the embodiments of FIGS. 3 and 4 the "further" treatment medium is put on the web of material first and the foam layer placed on top of it. In the apparatus 100 of FIG. 6, the first treatment medium present in the form of foam and the "further" treatment medium are applied simultaneously. The web of material 1 advances in the direction of the arrow 2 and may be supported in the region of application by means of a slide plate 103. A flat trough 104 which extends transversely over the width of the web and is opened at the top is disposed above the web of material. Trough 104 contains a dyeing liquor 105 with the lower part of a roll 106 immersed in the dyeing liquor 105. As the roll rotates in the direction of arrow 107 it picks up dyeing liquor 105 and carries it along with it. On its descending side, the dyeing liquor, now in the form of a film 108 is wiped off the roll 106 and flows down the inclined wiper 109, from the edge 110 of which it can drop onto the web 1. Thus, a uniform veil 111 of dye liquor falling from the edge of the wiper 109 results in the uniform application of the dye liquor to the web 1.

Above the cylinder 107 a foam container 114 having a funnel shaped cross section is disposed. It too extends over the width of the web of material. One of its walls 113 which the surface of the cylinder first reaches as it rotates in the direction of arrow 107 has a passage 114 of sufficient thickness so that the cylinder can rotate into the foam container 112 without the film of dyeing liquor 108 which is on the cylinder 106 being wiped off. Foam of a similar or different dyeing liquor is fed to foam container 112 by means of a feed pipe 115. The forward wall 116 of the foam container 112 terminates with its lower edge 117, in the illustrated embodiment, in the vicinity of the contact point of the wiper 109 with the cylinder 106. It is spaced from the cylinder 106 such as to leave a passage 118 through which the foam can leave the foam container 110 on top of the film of dyeing liquor 108 on the wiper 109. The foam thus forms a foam layer 119 on the wiper 109.

If the foam layer 119 is not disturbed it is transferred, along with the foam 108 of dyeing liquor, to the web of material 1 as a uniform layer. However, in the illustrated embodiment, a nozzle tube 120 is disposed parallel to the wiper 109 and is spaced at a distance above the foam layer 119. The nozzle tube 120 is adapted to be turned back and forth in the direction of the arrow 121 and is movable in and out of the plane of the drawing. From the nozzles 122 of the tube 120 a fluid medium, air in the illustrated embodiment, can be blown against the foam layer 119 displacing or loosening parts of the foam layer thereby.

Depending on the intensity of the blowing and the distance of the nozzle tube 120 from the foam layer 119, different degrees of loosening occur. The loosening can be to the extent that only a few of cakes of foam still reach the web of material as can be seen at 123. If the liquid 108 and the foam are aqueous or, in any case, miscible systems, running occurs at the edges of the foam cakes 123 which results in patterns with particularly soft transitions. Although the applied liquid and the liquid making up the foam are not generally miscible as used in practice, this does not constitute a detriment since desirable pattern effects are obtained otherwise through the interactions. Both the liquid and foam also need not serve the same purpose. For example, the liquid may be a wetting or thinning agent with only the foam containing pigment. Furthermore, a pattern need not necessarily be involved. Instead, impregnations of the most varied kind in which the interaction between the liquid and foam produces effects can be considered. Naturally, what is said concerning this embodiment applies also to the other embodiments where a liquid or paste and foam are utilized.

The pattern obtained on the web of material is dependent to a large degree on the height of the lower edge 110 of the wiper 109 above the web of material 1. This height is adjustable, in that entire arrangement including trough 104, cylinder 106, foam container 112, and nozzle tube 120 together can be adjusted vertically to different heights using a suitable lifting device. The closer the web of material passes under the lower edge 110 of the wiper 109, the more faithfully is the pattern appearing at the wiper 109 transferred to the web of material 1, while in the case of greater height it is scattered and loosened up more or less.

What is claimed is:

1. The method for treating a web comprising the steps of:

a. applying a layer of foam containing a web treatment medium to cover the web as it advances and allowing said layer of foam to act thereon; and b. after applying said foam, applying at least one further web treatment medium upon said foam in the form of a liquid, allowing said liquid to penetrate into said foam, allowing said foam layer and other treatment medium to interact before either becomes fixed with both treatment media acting on the web.

2. The method according to claim 1, and further including the step of applying one of said media in a pattern form in such a manner that the application areas of the two media overlap at least partially on the web.

3. The method according to claim 1, comprising applying said foam in the form of a uniform layer and wherein said liquid is in the form of a liquid film.

4. The method according to claim 1 wherein said web treatment media include dyestuffs.

5. The method according to claim 4 wherein said dyestuffs include textile dyeing materials.

6. The method according to claim 1 wherein said further treatment medium is non-uniformly applied.

* * * * *